US008224218B2

(12) United States Patent
Yoo et al.

(10) Patent No.: US 8,224,218 B2
(45) Date of Patent: Jul. 17, 2012

(54) REDISTRIBUTING UNIT, DEVELOPING DEVICE AND IMAGE FORMING APPARATUS HAVING THE SAME

(75) Inventors: Jae Bum Yoo, Suwon-si (KR); Jean Man Sur, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 707 days.

(21) Appl. No.: 12/239,929

(22) Filed: Sep. 29, 2008

(65) Prior Publication Data

US 2009/0226222 A1 Sep. 10, 2009

(30) Foreign Application Priority Data

Mar. 5, 2008 (KR) ..... 10-2008-0020396

(51) Int. Cl.
*G03G 15/16* (2006.01)

(52) U.S. Cl. ..... 399/296

(58) Field of Classification Search ..... 399/296
See application file for complete search history.

(56) References Cited

U.S. PATENT DOCUMENTS

2005/0008379 A1* 1/2005 Omata ..... 399/45
2005/0196206 A1* 9/2005 Arimura ..... 399/350

FOREIGN PATENT DOCUMENTS

JP 01134377 5/1989

* cited by examiner

*Primary Examiner* — David Gray
*Assistant Examiner* — Barnabas Fekete
(74) *Attorney, Agent, or Firm* — Stanzione & Kim LLP

(57) ABSTRACT

A developing device includes a photosensitive member having a surface on which a visible image is formed and a developing member to feed a developer to the photosensitive member, and an image forming apparatus having the developing device. The photosensitive member includes a developing region, to which the developer is transmitted by the developing member, and a transfer region, from which the developer of the photosensitive member is transmitted to a recording medium. A redistributing unit is disposed between the developing region and the transfer region, to redistribute the developer present on the photosensitive member. When developing a solid image and a halftone image in sequence is desired, even if a portion of the developer for use in development of the halftone image is prematurely transmitted to the photosensitive member, the redistributing unit can redistribute the transmitted developer so as to use the transmitted developer to develop the halftone image, resulting in a reduction in likelihood of image defects.

17 Claims, 7 Drawing Sheets

FIG. 1
(CONVENTIONAL)
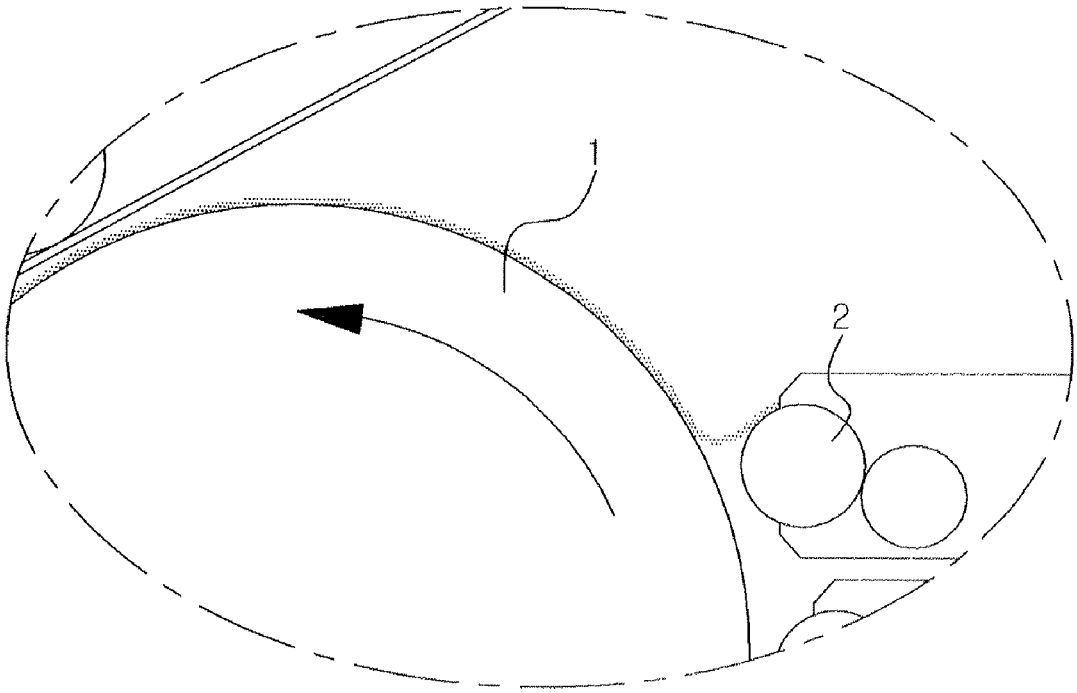

FIG. 2
(CONVENTIONAL)
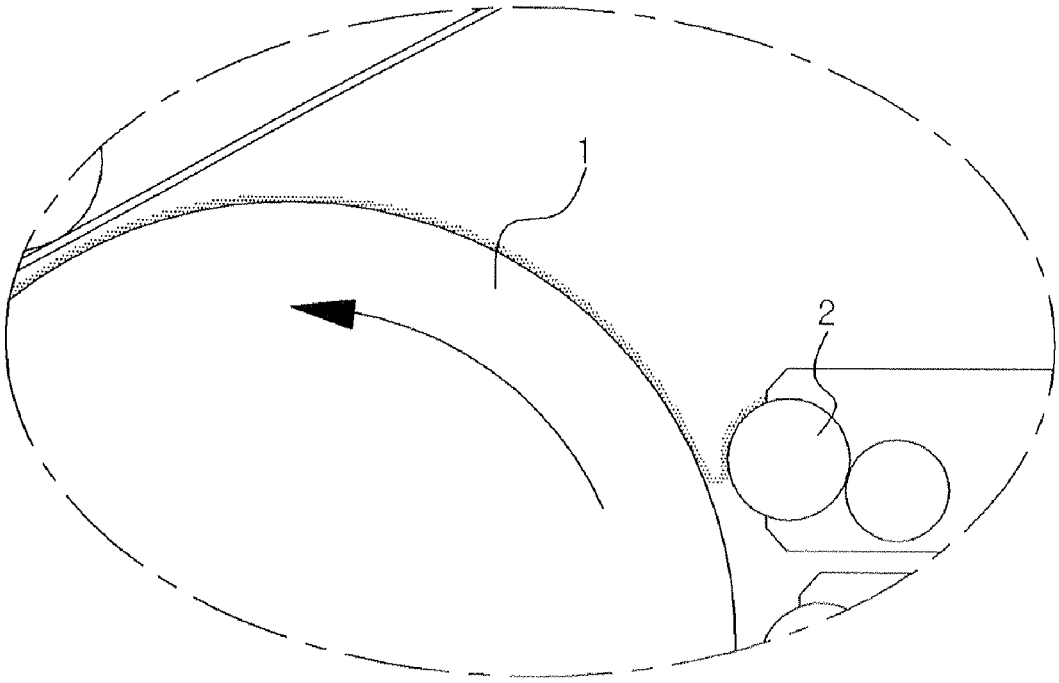

REDISTRIBUTING UNIT, DEVELOPING DEVICE AND IMAGE FORMING APPARATUS HAVING THE SAME

CROSS-REFERENCE TO RELATED APPLICATIONS

This application claims priority under 35 U.S.C. §119(a) from Korean Patent Application No. 2008-0020396, filed on Mar. 5, 2008 in the Korean Intellectual Property Office, the disclosure of which is incorporated herein in its entirety by reference.

BACKGROUND OF THE INVENTION

1. Field of the Invention

The present general inventive concept relates to a developing device and an image forming apparatus having the same, and, more particularly, to an image forming apparatus having a developing member to supply a developer to a photosensitive member on which an electrostatic latent image is formed.

2. Description of the Related Art

Generally, a developing device and an image forming apparatus having the same are used to form an image on a recording medium such as paper according to an input image signal.

Conventional image forming apparatuses principally include a body defining an external appearance of the apparatus, a paper supply unit to supply a recording medium such as paper, a developing device to develop an image on the recording medium, a fixing unit to fix the image on the recording medium by applying heat and pressure to the recording medium, etc. The developing device includes an exposure unit to irradiate a laser beam containing image information, a photosensitive member having a surface on which an electrostatic latent image is formed by the exposure unit, and a developing member to supply a developer to the photosensitive member so as to form a visible image on the photosensitive member.

Referring to FIG. 1 illustrating one exemplary conventional image forming apparatus, a developing member 2 is spaced apart from an outer circumferential surface of a photosensitive member 1 such that a developer is transmitted to the photosensitive member 1 in a non-contact manner by an electrostatic field between the photosensitive member 1 and the developing member 2. To enable the transmission of developer from the developing member 2 to the photosensitive member 1 by the electrostatic field, power is applied to both the photosensitive member 1 and the developing member 2 of the conventional image forming apparatus.

Using the above-described conventional image forming apparatus, since a relatively large amount of developer is used when developing a dark solid image, whereas a relatively small amount of developer is used when developing a light halftone image, development of the solid image applies a higher voltage to the photosensitive member 1 than development of the halftone image and consequently, causes a greater electrostatic force to be generated from the photosensitive member 1 than development of the halftone image. Accordingly, when developing the solid image, a developer is adsorbed from the developing member 2 to the photosensitive member 1 at a position farther away from the photosensitive member 1. Also, when developing the halftone image, as illustrated in FIG. 2, a developer is adsorbed from the developing member 2 to the photosensitive member 1 at a position closer to the photosensitive member 1.

In the above-described conventional image forming apparatus, however, since the developer is adsorbed to the photosensitive member at a position farther away from the photosensitive member upon development of the solid image than development of the halftone image, there is a problem in that, when a desired to develop the solid image and the halftone image in sequence exists, a portion of the developer for use in formation of the halftone image is prematurely adsorbed to the photosensitive member, thereby being used to develop the solid image rather than being used to form the halftone image, and causing defects in the resulting halftone image.

Furthermore, after extended use of the image forming apparatus, a surface of the developing member is liable to accumulate fine scratches due to frictional force applied thereto. Such a scratched surface region cannot properly retain the developer, making adsorption of the developer to a corresponding region of the photosensitive member difficult to ensure, and resulting in image defects.

SUMMARY OF THE INVENTION

The present general inventive concept provides a developing device capable of reducing likelihood of image defects in order to develop a solid image and a halftone image in sequence, and an image forming apparatus having the developing device.

The present general inventive concept also provides a developing device capable of reducing likelihood of image defects due to fine scratches on a developing member, and an image forming apparatus having the developing device.

Additional aspects and/or utilities of the present general inventive concept will be set forth in part in the description which follows and, in part, will be obvious from the description, or may be learned by practice of the general inventive concept.

The foregoing and/or other aspects and utilities of the general inventive concept may be achieved by providing a developing device illustrating a photosensitive member having a surface on which a visible image is formed, and a developing member to feed a developer to the photosensitive member, wherein the photosensitive member includes a developing region, to which the developer is transmitted by the developing member, and a transfer region, from which the developer of the photosensitive member is transmitted to a recording medium, and a redistributing unit is disposed between the developing region and the transfer region, to redistribute the developer present on the photosensitive member.

The redistributing unit may be spaced apart from an outer circumferential surface of the photosensitive member.

Alternating-current (AC) power may be applied to the redistributing unit.

Directing-current (DC) power may be further applied to the redistributing unit with the AC power, causing the developer present on the photosensitive member to oscillate between the redistributing unit and the photosensitive member to thereby be redistributed on the photosensitive member.

The redistributing unit may have a surface configured such that a distance from an outer circumferential surface of the photosensitive member gradually increases from a center toward an outer periphery thereof.

The redistributing unit may include a rotatably disposed roller.

The redistributing unit may include a circular cross sectional metal rod.

The redistributing unit may include a metal plate having a surface parallel to a tangential line of the photosensitive member.

The redistributing unit may include a metal plate having an arcuate cross sectional surface.

The foregoing and/or other aspects and utilities of the general inventive concept may also be achieved by providing an image forming apparatus including a developing device to develop an image, the developing device comprises a photosensitive member having a surface on which a visible image is formed, and a developing member to feed a developer to the photosensitive member, the photosensitive member comprises a developing region, to which the developer is transmitted by the developing member, and a transfer region, from which the developer of the photosensitive member is transmitted to a recording medium, and a redistributing unit is disposed between the developing region and the transfer region, to redistribute the developer present on the photosensitive member.

The foregoing and/or other aspects and utilities of the general inventive concept may also be achieved by providing a redistributing unit usable with a photosensitive member, the redistributing unit including a body disposed between a developing region of a photosensitive member, to which a developer is transmitted, and a transfer region of the photosensitive member, from which the developer is transmitted to a recording medium, the redistributing unit being used to redistribute the developer present on the photosensitive member.

The foregoing and/or other aspects and utilities of the general inventive concept may also be achieved by providing a developing device including a photosensitive member having a plurality of photosensitive regions, and to receive developer, a developing member having a plurality of developing regions, and to feed the developer to a respective photosensitive region of the photosensitive member from one of the plurality of developing regions, and a redistributing unit to redistribute a portion of the developer to another one of the plurality of developing regions to be feed to the respective photosensitive region of the photosensitive member.

The foregoing and/or other aspects and utilities of the general inventive concept may also be achieved by providing a developing device including a photosensitive member having a surface on which a visible image is formed, a developing member to feed a developer to the photosensitive member, and a redistribution unit to receive a directing-current (DC) power and an alternating current (AC) power to cause the developer present on the photosensitive member to oscillate between the redistributing unit and the photosensitive member.

BRIEF DESCRIPTION OF THE DRAWINGS

These and/or other aspects and utilities of the exemplary embodiments of the present general inventive concept will become apparent and more readily appreciated from the following description of the embodiments, taken in conjunction with the accompanying drawings, of which:

FIGS. 1 and 2 are schematic views illustrating a photosensitive member and a developing member applied to a conventional image forming apparatus;

DETAILED DESCRIPTION OF THE PREFERRED EMBODIMENTS

Figure 3:
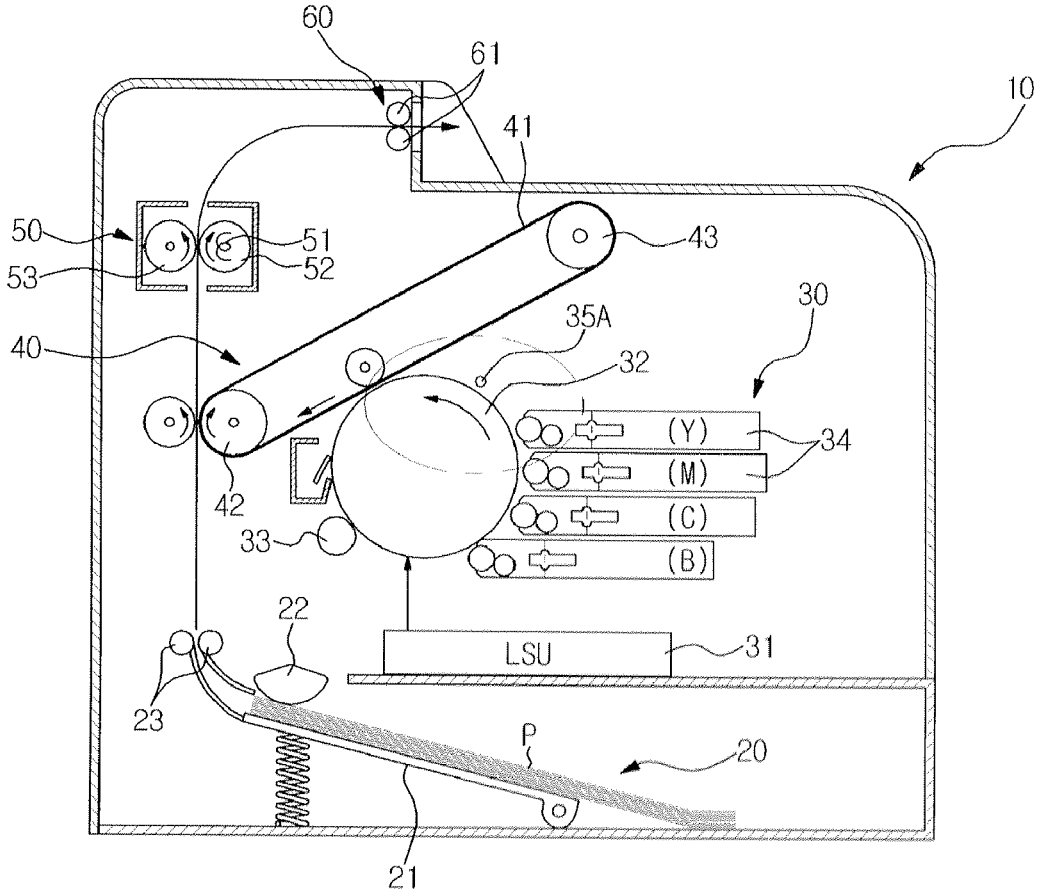
FIG. 3 is a sectional view illustrating a schematic configuration of an image forming apparatus in accordance with an embodiment of the present general inventive concept.

Reference will now be made in detail to exemplary embodiments of the present general inventive concept, examples of which are illustrated in the accompanying drawings, wherein like reference numerals refer to like elements throughout. The embodiments are described below to explain the present general inventive concept by referring to the figures.

Hereinafter, a developing device and an image forming apparatus having the developing device in accordance with an embodiment of the present general inventive concept will be described in detail with reference to the accompanying drawings.

The image forming apparatus in accordance with an embodiment of the present general inventive concept, as illustrated in FIG. 3, includes a body 10 defining an external appearance of the apparatus and serving to support a variety of elements disposed therein, a paper supply unit 20 to supply a recording medium P such as paper, a developing device 30 to develop an image into a visible image, a transfer device 40 to transfer the visible image developed by the developing device 30 to the recording medium P such as paper, a fixing unit 50 to fix the image on the recording medium P by applying heat and pressure to the recording medium P, and a paper discharge unit 60 to discharge the recording medium P, on which the image is printed, to the outside of the body 10.

The paper supply unit 20 includes a paper supply tray 21 in which plural sheets of recording media P are loaded, a pickup roller 22 to pick up the recording media S loaded in the paper supply tray 21 sheet by sheet, and a pair of conveyance rollers 23 disposed parallel to each other to allow the recording medium P to be conveyed through a gap between the conveyance rollers 23.

The developing device 30 includes an exposure unit 31 in the form of, for example, a laser scanning unit (LSU) to irradiate a laser beam containing image information, a drum-shaped photosensitive member 32 having a surface on which an electrostatic latent image is formed by the exposure unit 31, a charge roller 33 to charge the photosensitive member 32, and four developing cartridges 34 to develop the electrostatic latent image, formed on the photosensitive member 32, into a visible image using yellow, magenta, cyan and black developers.

Figure 4:
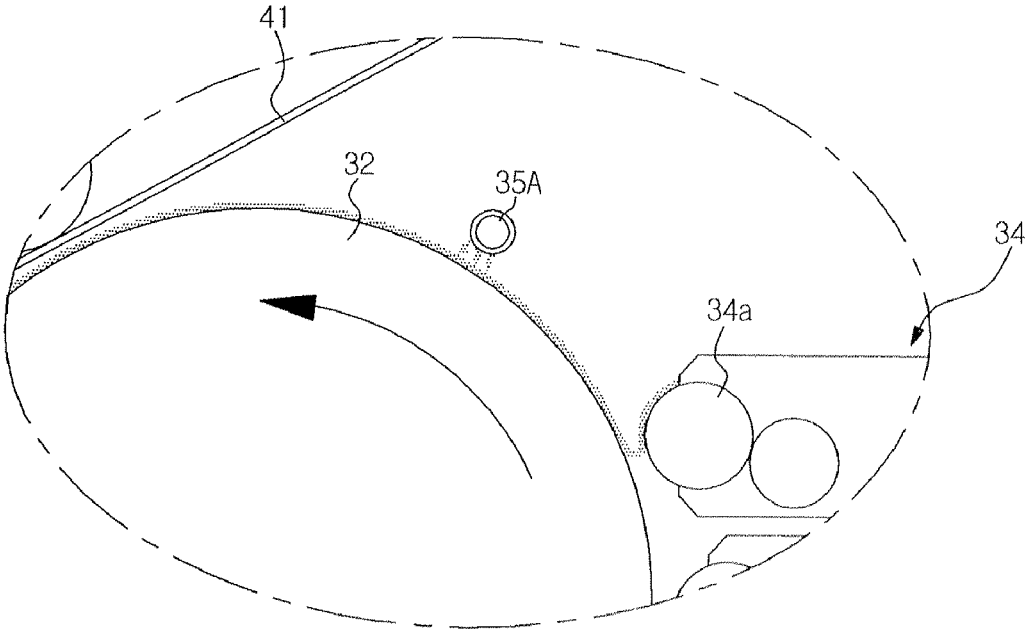
FIG. 4 is a schematic view illustrating a photosensitive member, a developing member, and a redistributing unit applied to the image forming apparatus in accordance with the embodiment illustrated in FIG. 3.

Referring to FIGS. 3 and 4, each developing cartridge 34 is provided with a roller-shaped developing member 34*a* (See FIG. 4) to feed a developer to the photosensitive member 32. In the present embodiment, the developing member 34*a* is spaced from the photosensitive member 32 such that a developer can be transmitted in a non-contact manner from the developing member 34*a* to the photosensitive member 32 by an electrostatic force between the photosensitive member 32 and the developing member 34*a*.

The exposure unit 31 incorporates a laser diode (not illustrated) to emit a laser beam, a polygonal mirror (not illustrated) to diverge the laser beam emitted from the laser diode, etc. Diverged laser beams, having passed through the polygonal mirror, are directed to the photosensitive member 32 located above the exposure unit 31, so as to form an electrostatic latent image on the photosensitive member 32.

The transfer device 40 includes a belt-shaped transfer member 41 arranged to receive the developer transmitted from the photosensitive member 32 to thereby transmit the developer to the recording medium P, and a pair of transfer rollers 42 and 43 spaced apart from each other to move the transfer member 41.

The fixing unit 50 serves to fix the visible image on the recording medium P by applying heat and pressure to the recording medium P. The fixing unit 50 includes a heating roller 52 in which a heater 51 is disposed to apply heat to the recording medium P to which the developer was transferred, and a pressure roller 53 disposed opposite the heating roller 52 to maintain a constant fixing pressure in a gap between the heating roller 52 and the pressure roller 53.

The paper discharge unit 60 includes paper discharge rollers 61 disposed to convey the recording medium P, having passed through the fixing unit 50, to the outside of the body 10.

The above-described image forming apparatus in accordance with the present embodiment further includes redistributing unit 35A as illustrated in FIG. 4, to reduce a likelihood of image defects when developing a dark solid image and a light halftone image in sequence is desired and a likelihood of image defects due to fine scratches on the respective developing members 34*a*.

The redistributing unit 35A is disposed between the developing members 34*a* and the transfer member 41 and is spaced apart from an outer circumferential surface of the photosensitive member 32. With this arrangement, the redistributing unit 35A redistributes the developer, which is fed from the respective developing members 34*a* and is present on the outer circumferential surface of the photosensitive member 32, before the developer is transmitted to the transfer member 41, thereby serving to reduce image defects. Here, the photosensitive member 32 has a developing region which is provided adjacent to the developing members 34*a* to receive the developer from the respective developing members 34*a*, and a transfer region which is provided adjacent to the recording medium P or the transfer member 41 to transmit the developer to the recording medium P or the transfer member 41. The redistributing unit 35A is disposed between the developing region and the transfer region, and can redistribute the developer transmitted from the developing members 34*a* through the developing region before the developer enters the transfer region. In the present embodiment, the above-described redistributing unit 35A having a body taking a form of a roller rotatably disposed such that an outer circumferential surface of the roller is spaced apart from the outer circumferential surface of the photosensitive member 32.

To redistribute the developer, adsorbed to the outer circumferential surface of the photosensitive member 32, using the redistribution unit 35A as described above, AC and DC voltages must be applied simultaneously to the redistribution unit 35A. When applying simultaneously AC and DC voltages to the redistribution unit 35A, the developer, adsorbed to the outer circumferential surface of the photosensitive member 32, oscillates between the photosensitive member 32 and the redistributing unit 35A by the AC voltage applied to the redistributing unit 35A and finally, is again adsorbed to the photosensitive member 32 by the DC voltage applied to the redistributing unit 35A. In this way, redistribution of the developer can be accomplished.

Accordingly, when developing a solid image and a halftone image in sequence is desired, even if a portion of the developer for use in development of the halftone image is prematurely transmitted to the photosensitive member 32, the redistributing unit 35A can redistribute the transmitted developer, so as to allow the developer to be properly used to develop the halftone image. This reduces likelihood of image defects upon sequential development of a solid image and a halftone image.

In addition, even if fine scratches occur at the developing member 34*a* after extended use and thus, a scratched region of the developing member 34*a* cannot properly feed the developer to a corresponding region of the photosensitive member 32, the redistributing unit 35A can redistribute a portion of the developer adsorbed to a region next to the scratched region, so as to feed the developer to the problematic region of the photosensitive member 32 where the proper feeding of developer is not accomplished, thereby reducing likelihood of image defects.

Figure 5:
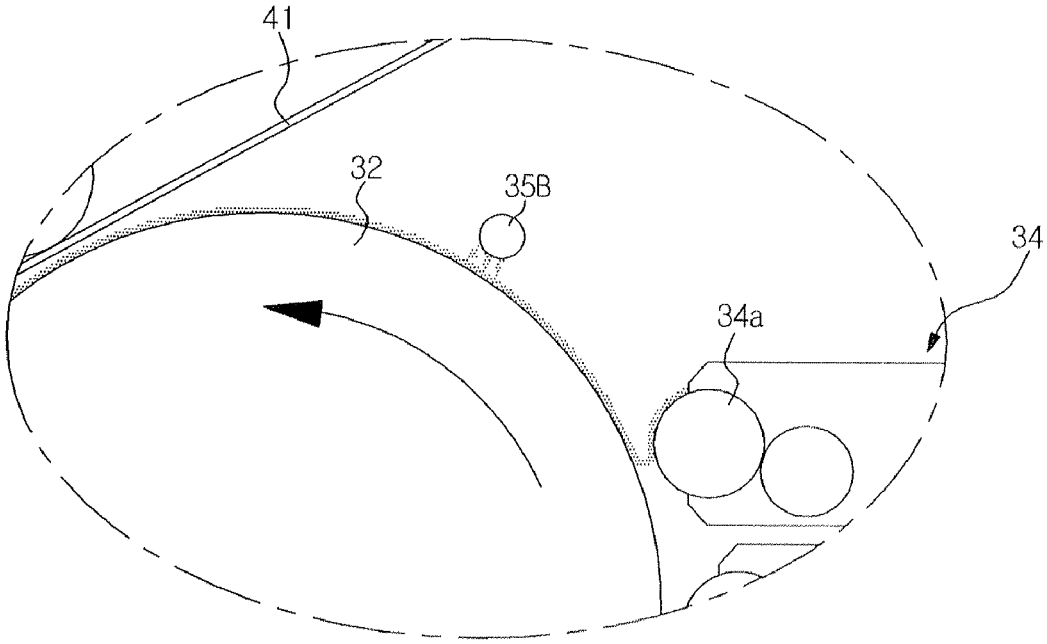
FIG. 5 is a schematic view illustrating a photosensitive member, a developing member, and a redistributing unit applied to an image forming apparatus in accordance with an embodiment of the present general inventive concept.
Figure 6:
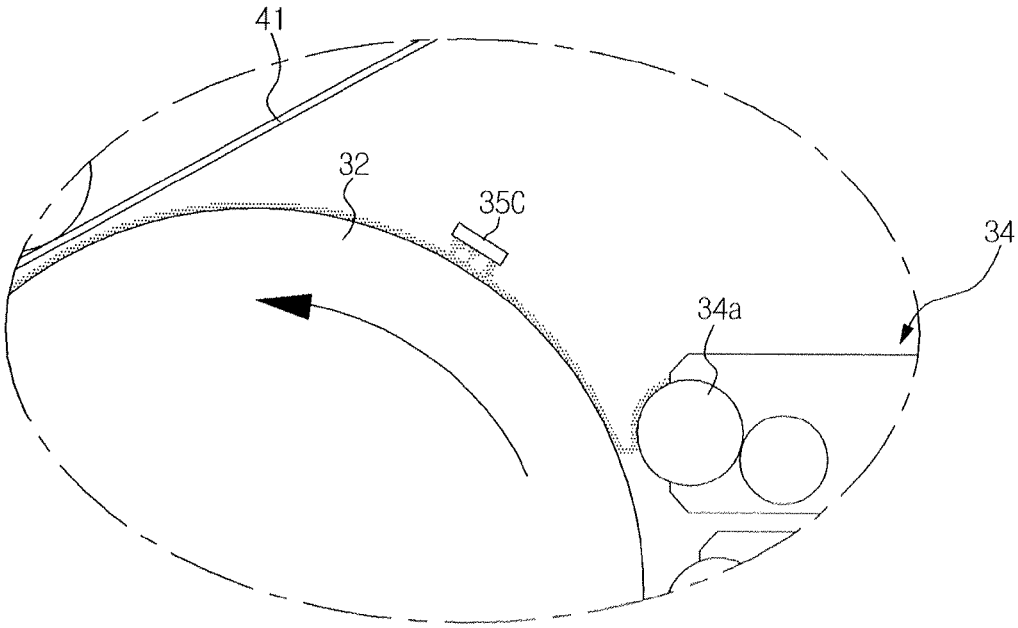
FIG. 6 is a schematic view illustrating a photosensitive member, a developing member, and a redistributing unit applied to an image forming apparatus in accordance with an embodiment of the present general inventive concept.
Figure 7:
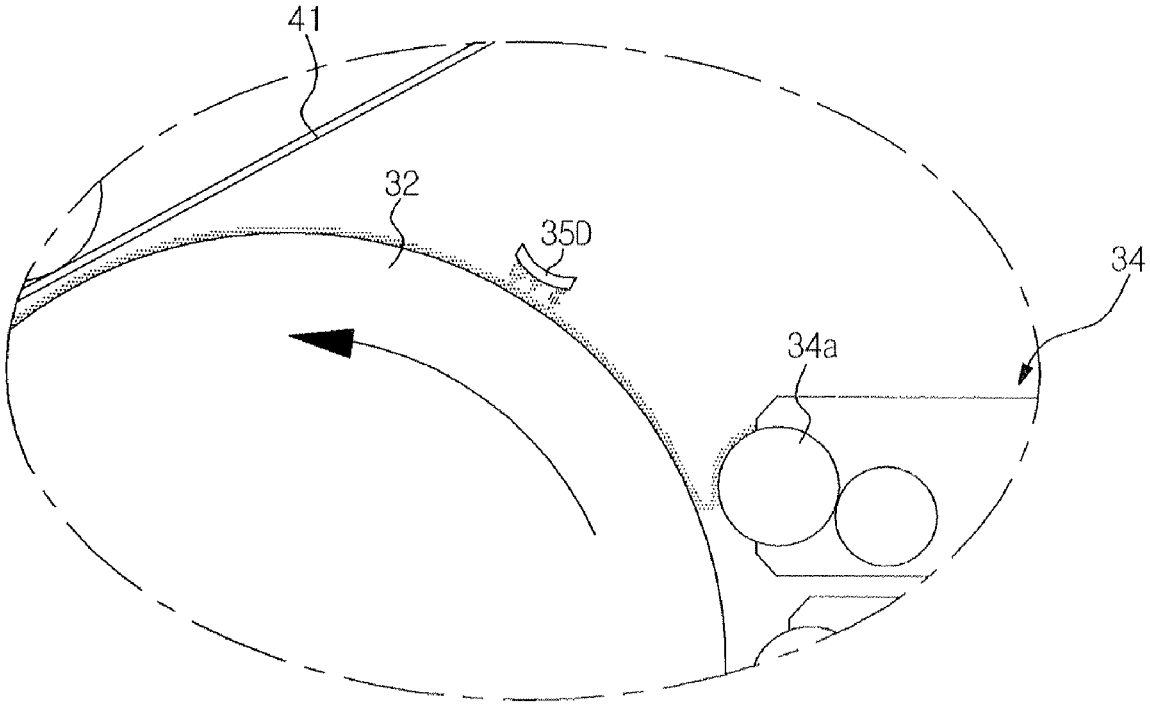
FIG. 7 is a schematic view illustrating a photosensitive member, a developing member, and a redistributing unit applied to an image forming apparatus in accordance with an embodiment of the present general inventive concept.

FIGS. 5 to 7 illustrate different embodiments of redistributing units 35B, 35C and 35D of various shapes, which are applicable to the image forming apparatus in accordance with the present general inventive concept.

FIG. 5 illustrates a redistributing unit 35B in accordance with an embodiment of the present general inventive concept, which takes a form of a circular cross sectional metal rod, FIG. 6 illustrates a redistributing unit 35C in accordance with an embodiment of the present general inventive concept, which takes a form of a metal plate having a surface parallel to a tangential line of the photosensitive member 32, and FIG. 7 illustrates a redistributing unit 35D in accordance with an embodiment of the present general inventive concept, which takes a form of a metal plate having an arcuate cross sectional surface. These redistributing units 35B, 35C and 35D in accordance with the embodiments illustrated in FIGS. 5-7 commonly have a surface configured such that a distance from the outer circumferential surface of the photosensitive member 32 increases from a center toward an outer periphery thereof. With this configuration, these redistributing units 35B, 35C and 35D can perform the same operation as the redistributing unit 35A in accordance with the embodiment illustrated in FIG. 3.

Although the above-described embodiments of the present general inventive concept illustrate the image forming apparatus in which the photosensitive member 32 and the developing members 34*a* are spaced apart from each other to achieve the non-contact feeding of developer from the developing members 34*a* to the photosensitive member 32, the present general inventive concept is not limited thereto and can be directly applied to a case wherein the photosensitive member 32 and the developing members 34*a* come into contact with each other, in order to reduce likelihood of image defects due to various factors.

In addition, although the above-described embodiments illustrate the image forming apparatus in which the photosensitive member 32 and the developing members 34*a* rotate in opposite directions, the present general inventive concept is not limited thereto and can be directly applied to a case wherein the photosensitive member 32 and the developing member 34*a* rotate in the same direction.

Although the above-described embodiments illustrate the image forming apparatus in which a plurality of developing members 34*a* are provided to develop black-and-white and color images, the present general inventive concept is not limited thereto and can be directly applied to a case wherein a single developing member 34*a* is provided to perform only black-and-white printing.

Also, although the above-described embodiments illustrate that the developer present on the outer circumferential surface of the photosensitive member 32 is transferred to the belt-shaped transfer member 41 and then, is again transferred to the recording medium P, the present general inventive concept is not limited thereto and can allow the developer present on the outer circumferential surface of the photosensitive member 32 to be directly transferred to the recording medium P.

Finally, although the above-described embodiments illustrate that both DC and AC voltages are applied to the redistributing unit 35A, the present general inventive concept is not limited thereto and can be embodied in such a manner that the redistributing unit 35A can perform redistribution of developer even when only DC voltage is applied thereto.

As apparent from the above description, with the developing device and the image forming apparatus having the same in accordance with various embodiments of the present general inventive concept, when developing a solid image and a halftone image in sequence is desired, even if a portion of developer for use in formation of the halftone image is prematurely transmitted to the photosensitive member, the redistributing unit can redistribute the developer so as to allow the developer to be properly used to form the halftone image. As a result, the present general inventive concept has the effect of reducing likelihood of image defects.

Further, with the developing device and the image forming apparatus having the same in accordance with various embodiments of the present general inventive concept, even if fine scratches accumulate on the developing member after extended use and thus, a scratched region of the developing member prevents proper feeding of the developer to a corresponding region of the photosensitive member, the redistributing unit can redistribute a portion of the developer adsorbed to a region next to the scratched region, so as to feed the developer to the problematic region of the photosensitive member where the proper feeding of developer is not accomplished. This also has the effect of reducing likelihood of image defects.

Although various embodiments of the present general inventive concept have been illustrated and described, it would be appreciated by those skilled in the art that changes may be made in this embodiment without departing from the principles and spirit of the general inventive concept, the scope of which is defined in the claims and their equivalents.

What is claimed is:

1. A developing device, comprising:

a photosensitive member having a surface on which a visible image is formed; and a developing member to feed a developer to the photosensitive member wherein the photosensitive member includes a developing region, to which the developer is transmitted by the developing member, and a transfer region, from which the developer of the photosensitive member is transmitted to a recording medium, and a redistributing unit is disposed between the developing region and the transfer region, to redistribute the developer present on the photosensitive member, wherein an alternating-current (AC) power is applied to the redistributing unit to cause the developer to oscillate between the redistributing unit and the photosensitive member and a direct-current (DC) power is further applied to the redistributing unit to cause the developer to adsorb to the photosensitive member to thereby redistribute the developer present on the photosensitive member.

2. The developing device according to claim 1, wherein the redistributing unit is spaced apart from an outer circumferential surface of the photosensitive member.

3. The developing device according to claim 1, wherein the redistributing unit has a surface configured such that a distance from an outer circumferential surface of the photosensitive member gradually increases from a center toward an outer periphery thereof.

4. The developing device according to claim 3, wherein the redistributing unit comprise:

a rotatably disposed roller.

5. The developing device according to claim 3, wherein the redistributing unit comprises:

a circular cross sectional metal rod.

6. The developing device according to claim 3, wherein the redistributing unit comprises:

a metal plate having a surface parallel to a tangential line of the photosensitive member.

7. The developing device according to claim 3, wherein the redistributing unit comprises:

a metal plate having an arcuate cross sectional surface.

8. An image forming apparatus, comprising:

a developing device to develop an image, the developing device comprises:

a photosensitive member having a surface on which a visible image is formed, and a developing member to feed a developer to the photosensitive member, the photosensitive member comprises a developing region, to which the developer is transmitted by the developing member, and a transfer region, from which the developer of the photosensitive member is transmitted to a recording medium, and a redistributing unit is disposed between the developing region and the transfer region, to redistribute the developer present on the photosensitive member, wherein an alternating-current (AC) power is applied to the redistributing unit to cause the developer to oscillate between the redistributing unit and the photosensitive member and a direct-current (DC) power is further applied to the redistributing unit to cause the developer to adsorb to the photosensitive member to thereby redistribute the developer present on the photosensitive member.

9. The image forming apparatus according to claim 8, wherein the redistributing unit is spaced apart from an outer circumferential surface of the photosensitive member.

10. The image forming apparatus according to claim 8, wherein the redistributing unit has a surface configured such that a distance from an outer circumferential surface of the photosensitive member gradually increases from a center toward an outer periphery thereof.

11. A redistributing unit usable with a photosensitive member, the redistributing unit comprising:

a body disposed between a developing region of the photosensitive member, to which a developer is transmitted, and a transfer region of the photosensitive member, from which the developer is transmitted to a recording medium, wherein the redistributing unit being used to redistribute the developer present on the photosensitive member, and wherein an alternating-current (AC) power is applied to the redistributing unit to cause the developer to oscillate between the redistributing unit and the photosensitive member and a direct-current (DC) power is further applied to the redistributing unit to cause the developer to adsorb to the photosensitive member to thereby redistribute the developer on the photosensitive member.

12. The redistributing unit according to claim 11, wherein the redistributing unit is spaced apart from an outer circumferential surface of the photosensitive member.

13. The redistributing unit according to claim 11, wherein the redistributing unit has a surface configured such that a distance from an outer circumferential surface of the photosensitive member gradually increases from a center toward an outer periphery thereof.

14. A developing device, comprising:

a photosensitive member having a plurality of photosensitive regions, and to receive developer;

a developing member having a plurality of developing regions, and to feed the developer to a respective photosensitive region of the photosensitive member from one of the plurality of developing regions; and a redistributing unit to redistribute a portion of the developer present on the one of the plurality of photosensitive region to another one of the plurality of photosensitive region, wherein an alternating-current (AC) power is applied to the redistributing unit to cause the portion of the developer to oscillate between the redistributing unit and the photosensitive member and a direct-current (DC) power is further applied to the redistributing unit to cause the portion of the developer to adsorb to the photosensitive member to thereby redistribute the portion of the developer present on the one of the plurality of photosensitive region to another one of the plurality of photosensitive region.

15. A developing device, comprising:

a photosensitive member having a surface on which a visible image is formed;

a developing member to feed a developer to the photosensitive member; and a redistribution unit to receive an alternating-current (AC) power to cause the developer to oscillate between the redistributing unit and the photosensitive member and to receive a direct-current (DC) power to cause the developer to adsorb to the photosensitive member to thereby redistribute the developer on the photosensitive member.

16. A method of operating a developing device, comprising:

feeding developer to a photosensitive unit having a surface on which a visible image is formed;

redistributing the developer on the photosensitive unit when developing a halftone image after a solid image; and transferring the developer from the photosensitive unit to a recording medium after redistribution of the developer, wherein the redistributing the developer includes applying an alternating-current (AC) power to cause the developer to oscillate between a redistributing unit and the photosensitive unit and applying a direct-current (DC) power to cause the developer to adsorb to the photosensitive unit to thereby redistribute the developer on the photosensitive unit.

17. A developing device, comprising:

a photosensitive member having a surface on which a visible image is formed, including a developing region where developer is applied and a transfer region where the developer is transmitted to a recording medium;

a developing member to apply the developer to the photosensitive member; and a redistributing unit disposed between the developing region and the transfer region to redistribute the developer on the photosensitive member between applications, wherein an alternating-current (AC) power is applied to the redistributing unit to cause the developer to oscillate between the redistributing unit and the photosensitive member and a direct-current (DC) power is further applied to the redistributing unit to cause the developer to adsorb to the photosensitive member to thereby redistribute the developer on the photosensitive member.

* * * * *